US005086304A

United States Patent [19]

Collins

[11] Patent Number: 5,086,304

[45] Date of Patent: * Feb. 4, 1992

[54] FLAT PHASED ARRAY ANTENNA

[75] Inventor: John L. Collins, Leven, Scotland

[73] Assignee: Integrated Visual, Inc., Quincy, Ill.

[ * ] Notice: The portion of the term of this patent subsequent to Sep. 25, 2007 has been disclaimed.

[21] Appl. No.: 587,863

[22] Filed: Sep. 25, 1990

Related U.S. Application Data

[63] Continuation of Ser. No. 84,664, Aug. 12, 1987, Pat. No. 4,959,658.

[51] Int. Cl.[5] ..... H01Q 13/00

[52] U.S. Cl. ..... 343/778; 343/786; 343/797

[58] Field of Search ..... 343/778, 786, 797, 776, 343/700 MS

[56] References Cited

U.S. PATENT DOCUMENTS

| | | | |
|---|---|---|---|
| 4,486,758 | 12/1984 | De Ronde | 343/700 MS |
| 4,527,165 | 7/1985 | De Ronde | 343/786 |
| 4,626,865 | 12/1986 | Rammos | 343/786 |
| 4,959,658 | 9/1990 | Collins | 343/786 |

*Primary Examiner*—Michael C. Wimer
*Assistant Examiner*—Hoanganh Le
*Attorney, Agent, or Firm*—Mason, Fenwick & Lawrence

[57] ABSTRACT

A flat phased array antenna for reception of circularly polarized high frequency signals. The flat antenna array consists of a number of subarrays arranged in a matrix. In turn, each of the subarrays consist of individual antenna elements arranged in a matrix. In one embodiment, each subarray consists of four layers stacked one on top of the other. The top layer defines an array of miniature reception horns. Secured to the top layer is a second layer which constitutes the short-circuit plate of the antenna array. The short-circuit plate contains a plurality of through holes disposed about the surface of the circuit plate to permit passage of pairs of cylindrically shaped probes. The two remaining layers constitute the first power dividing layer and the second power dividing layer, respectively. Each of the layers includes transmission line waveguides. The complete interior surface of the waveguides is coated with a metallic film and contains a number of spaced non-conductive supports for supporting a metallic conductor at the central location of the waveguide when the channel is viewed in cross-section. This arrangement creates a rectangular coaxial transmission line with the conductor forming the central conductor and the metallically coated channel forming the outer conductor. At the end of certain channels are the vertically extending, cylindrically shaped non-conductive probes.

2 Claims, 5 Drawing Sheets

FIG-5
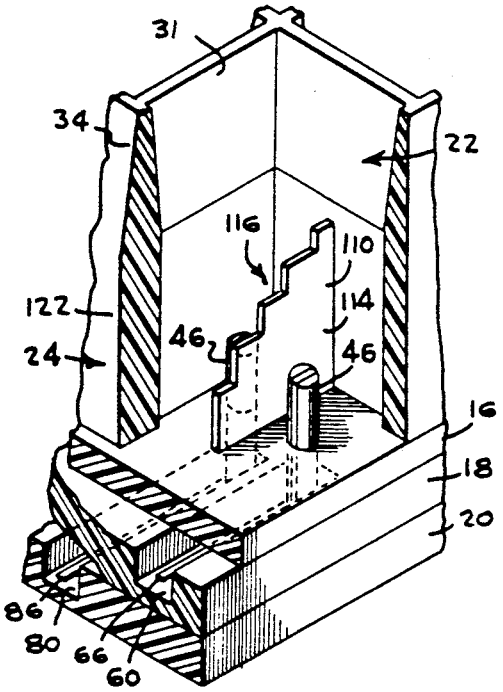
FIG-6
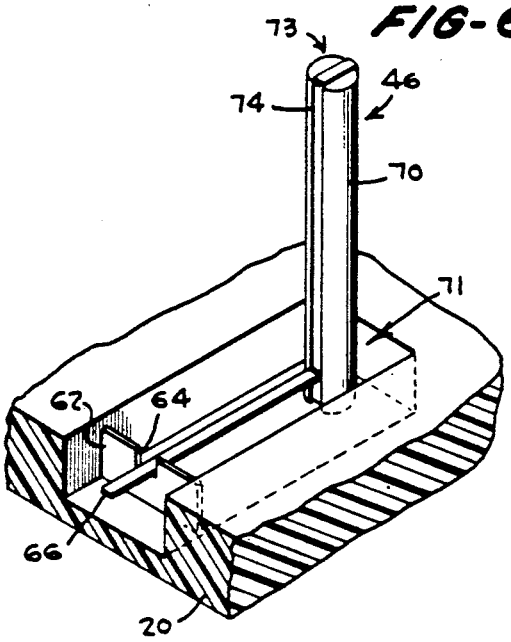
FIG-7
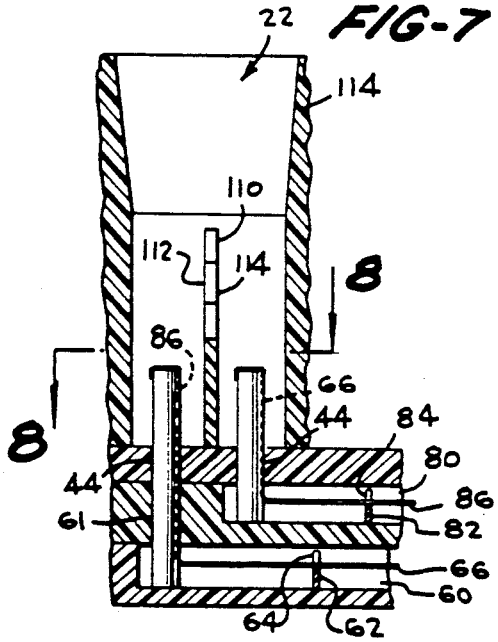
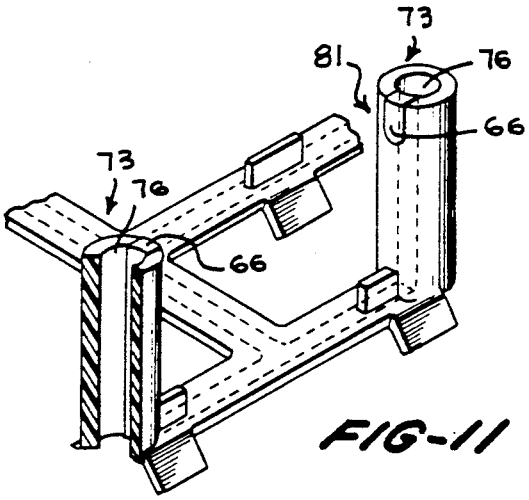
FIG-11
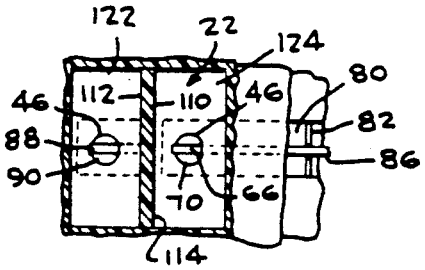
FIG-8

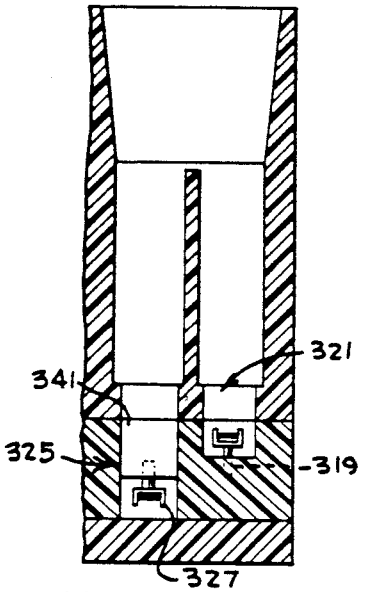
FIG-12
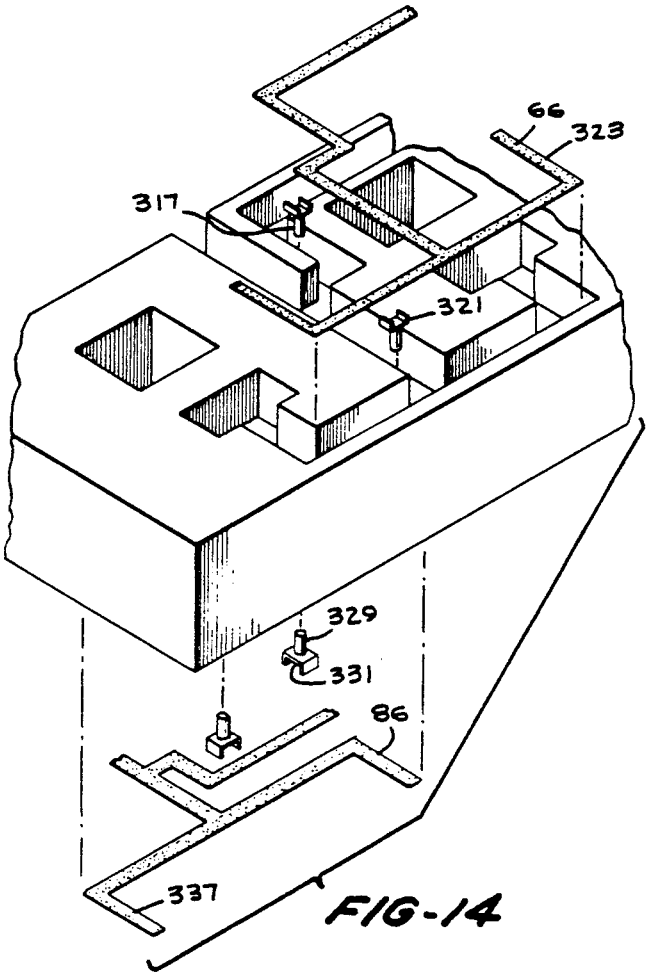
FIG-14
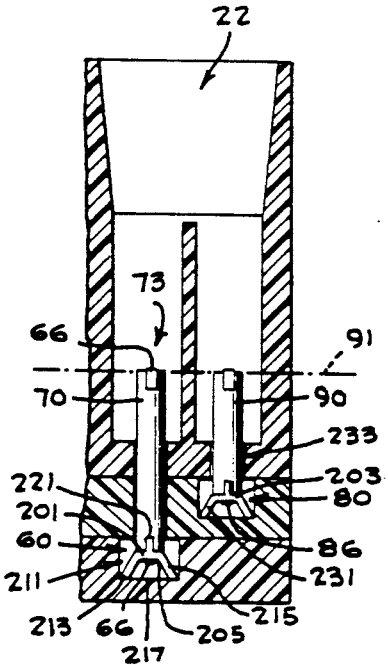
FIG-13
FIG-15
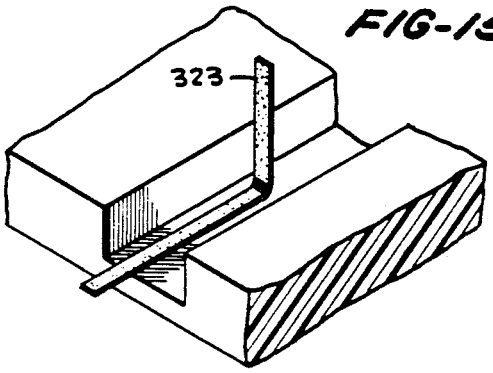

FLAT PHASED ARRAY ANTENNA

This application is a continuation of Ser. No. 07/084,664 filed on Aug. 12, 1987, now U.S. Pat. No. 4,959,658.

FIELD OF THE INVENTION

The present invention relates to antennas for reception of direct broadcast services, in general, and to antennas in the form of a flat phased array for reception and transmission of circularly polarized high frequency signals, in particular.

BACKGROUND OF THE INVENTION

The number of direct broadcast services from satellites continues to increase, particularly in the United States. There is, therefore, an expanding market for low cost ground terminals operating at a number of frequencies in the microwave region. Currently, these involve the use of reflector antennas with diameters typically in the range from 0.5 to 2 meters. Because of their simplicity, these antennas currently represent the lowest cost option. In today's developing market, several design alternatives are currently being explored including the use of antennas made from flat plate arrays.

The market for earth stations with antennas under 2 meters in diameter continues to grow. Applications for such antennas include business communications for data collection or dissemination, remote control and inventory management with projected network sizes ranging from a few hundred terminals to tens of thousands of stations. Typically, the system is based around a 12/14 GHz satellite service with a master station (employing a 5 to 10 meters antenna and high power amplifiers) making up for the relatively low gain of the "micro" earth station.

Many of the systems currently under development employ reflector antennas. These are simple to produce using a variety of techniques and there is considerable competition resulting from the large number of manufacturers entering the market, particularly in the United States where the development is most rapid. It has generally been assumed that flat plate array technologies, despite many attractive features, are not viable when the dimensions are greater than, say, 1.0 meter because of the increased complexity and, therefore, manufacture and assembly costs, a large proportion of which is due to the need to connect the cavity exciter probe with the feeder board. However, it is now evident that the cost differential can be made sufficiently small (by using, for example, inexpensive materials and injection molding techniques) and could be more than offset by the size reduction and the aesthetic appeal of a flat plate array.

Early flat plate array designs were based on microstrip configurations etched on high performance plastic substrates. These employ patch radiators, fed from a co-planar microstrip power dividing network or comb-lines which consist of a series of open-circuit stubs directly connected to a single microstripline. Although suitable for low or medium gain applications where a low profile is essential, they have a number of disadvantages. These include:

(1) The high cost of low loss substrates (e.g., glass fiber reinforced Teflon or PTFE).

(2) The narrow bandwidth of the radiators (which are generally operated about resonance).

(3) The increase in losses with frequency which become unacceptable in larger arrays.

(4) The poor sidelobe performance resulting from spurious radiation associated with the microstrip feed network.

Although improvements have been made using, for example, multilayer configurations incorporating shielded feed networks and sandwich support structures for the radiating elements, experience suggests that the technology is most appropriate at frequencies up to, say, 5 GHz and difficulties in scaling limits its applicability to the 12/14 GHz bands.

A number of prior art array configurations have been considered for direct broadcast service applications. Initially, interest centered on designs based on an open microstrip, including arrays of patches and comb-lines. These were found to have a number of drawbacks, however, including bandwidth limitations, radiation from the open feeding network and substrate losses which become more significant as the array size is increased. Alternative designs were, therefore, pursued which are based on cavity radiators fed from low loss feeder networks in, for example, suspended stripline. These offer better performance in terms of radiation pattern control and efficiency. However, in contrast with microstrip arrays, the structure is three-dimensional and, therefore, novel manufacturing approaches are required to realize it in a low cost form.

U.S. Pat. No. 4,054,874 relates to a high frequency antenna formed from elements by means of which circularly polarized signals can be transmitted or received. Each element is assembled from a pair of conducting dipoles which are joined in a cross-wise configuration by means of their central portions to constitute one single device, coupled to the ends of corresponding transmission lines. The lengths of the transmission lines differ by $\frac{1}{4}$ of the wavelength associated with the frequency of the transmitted or received signals in order that these useful signals are in phase quadrature.

U.S. Pat. No. 4,486,758 (de Ronde) relates to an antenna element for circularly polarized high frequency signals. The element includes a pair of superposed planar dielectric layers. An outer surface of each layer is covered with an electrically conductive layer forming a ground plane and having a circular opening defining respective cavities. Orthogonally crossed dipoles are disposed between the dielectric layers and adjacent the openings for coupling radiation to the feed line through striplines also disposed between the dielectric layers.

U.S. Pat. No. 4,527,165 (de Ronde) relates to a miniature horn antenna array for circularly polarized high frequency signals. An insulating layer includes openings defined by metal plates walls forming miniature horns, each having a square cross-section. A dielectric layer adjacent the insulating layer supports a first supply network for signals whose direction of polarization is of a first type of linear polarization. A second insulating layer adjacent the dielectric layer includes openings defined by metal plated walls forming miniature waveguides each having the same square cross-section as a respective horn, at the side facing the first network, and having a rectangular cross-section at the other side. A second dielectric layer adjacent the second insulating layer supports a second supply network for signals whose direction of polarization is perpendicular to the polarization of the signals of the first network. A third insulating layer adjacent the second dielectric layer includes openings defined by metal plated walls forming miniature waveguides each having the same rectangular cross-section as a respective waveguide in the second insulating layer, at the side facing the second network, and which has a depth smaller than the thickness of the third insulating layer.

The de Ronde patent '165 provides a configuration in which the suspended stripline feed network is interleaved between the elements. The array is made up of a series of layers with the suspended stripline central conductor formed on a thin, highly flexible Kapton sheet. Coupling to the radiating elements is realized by extending the ends of the suspended stripline conductor into the cavities to form an E-field probe.

In the de Ronde '165 patent the suspended stripline transmission line consists of a thin Kapton sheet clamped between plates in which mirror imaged channels are formed. The central conductor is etched on the surface of the Kapton sheet, with a width chosen to achieve the desired characteristic impedance. A complete singly polarized array then consists of two plates (which may be either machined directly from solid aluminum or formed in plastic and then metallized) with a single sheet of Kapton between them. The top plate includes the radiating apertures and the upper section of the power dividing network. The lower portion of the power dividing network and the shortened section of the radiators are incorporated into the lower plate.

There is thus a need for an improved flat phased array antenna assembled from economic materials such as plastic by modern techniques including injection molding and yielding superior result. The present invention is directed to filling that need.

SUMMARY OF THE INVENTION

The present invention relates to flat phased array antennas for reception of circularly polarized high frequency signals. A preferred embodiment of a flat antenna array incorporating the teachings of the present invention consists of nine antenna subarrays arranged next to each other in a $3\times3$ matrix. In turn, each of the subarrays consist of 256 individual elements arranged in a $16\times16$ matrix. Each of the elements has a spacing of $0.95\ \lambda_o$ where $\lambda_o$ is the free space wavelength at 12 GHz.

Each subarray consists of four layers stacked one on top of the other. Each of the layers is fabricated from an insulated material such as plastic. The top layer defines a $16\times16$ array of miniature horns of the type commonly used for receiving circularly polarized high frequency signals.

In a preferred embodiment, each of the horns has a lower section of generally square cross-section and an upper face of generally square cross-section. The square defining the upper portion is of greater dimension than the square defining the lower cross-section of the miniature horn. The upper portion of each horn radiates inwardly through the provision of planar walls in conventional fashion to define a radiating section.

The bottom of the top layer terminates in a planar surface. Each of the antenna elements extends completely from the top surface of the first layer clear through to the bottom surface of the same layer. Secured to the bottom of the first layer is another layer which constitutes the short-circuit plate of the antenna array. The plate comprises a planar plastic member having a top planar surface and a bottom planar surface. The top surface is coated by a thin layer of conductive metal such as aluminum. The metallic layer of the short-circuit plate is in intimate contact with the lower surface of the horn array. The short-circuit plate contains a plurality of through holes disposed about the surface of the circuit plate in accordance with a pattern to permit passage of probes of any shape (including cylinders) therethrough. The interior surface of each of the antenna elements is coated with a metallic film which will reflect microwave energy. One such metallic film may be made from aluminum.

The two remaining layers constitute the first power dividing layer and the second power dividing layer, respectively. The second power dividing layer is generally planar and contains a top planar surface and a bottom planar surface. The top surface contains a transmission network made up of series of waveguide transmission lines. Each transmission line consists of a hollow groove or channel. In a preferred embodiment, the grooves are generally rectangular in cross-section. However, depending on the intended use, the cross-section may take on other dimensional cross-sections such as a square. Positioned at predetermined locations throughout the channel are a series of conductor supports. The complete interior surface of the channel is coated with a metallic film such as aluminum. Each of the supports contains an indentation for supporting a metallic conductor at the central location of the channel when the channel is viewed in cross-section. This arrangement creates a rectangular coaxial transmission line with the conductor forming the central conductor and the metallically coated channel forming the outer conductor. At the end of certain channels are vertically extending, cylindrically shaped plastic posts which define the general structure of a probe.

Through the provision of either a longitudinally extending indentation or a longitudinally extending central bore, the conductor associated with a channel containing a probe extends from the secured lowered end of the probe to the free end of the probe and is then hooked to the top of the probe in a conventional manner to define an E-field probe.

An arrangement of transmission lines are defined in the first power dividing layer. These lines are similar to those defined in the second power dividing layer. The transmission lines in the first power dividing layer also include a probe structure.

In use, the horn radiators are fed from the rear using the "hook"-type probes. To ensure adequate isolation between polarizations, an end-fed septum acts as an orthomode transducer to provide orthogonal linear polarizations at 45° to the plane of the septum. Conventionally, this component is designed to introduce a 90° phase shirt between the two linear components in order to produce circular polarization. The septum is designed for an optimized in-phase relationship in accordance with conventional practice.

In another preferred embodiment, the subarrays consist of 16 individual elements arranged in a $4\times4$ matrix. Basically, each subarray consists of three layers stacked one on top of the other. The top layer, molded as a single piece, is essentially the same as the combination of the top two layers of the first embodiment.

The two remaining layers constitute the first power dividing layer and the second power dividing layer, respectively, and are of the same configuration and construction as the first embodiment. Positioned within the channels defined in the bottom layer is a planar network of interconnected strips made of a non-conductive material such as plastic. The strips are positioned within each channel so that the plane of each strip is essentially parallel to the plane of the bottom layer and so that the undersurface of the strip is approximately halfway into the channel. A metallic conductor is secured to undersurface along the longitudinal axis of each strip.

Positioned at predetermined locations throughout the channel are a series of strip supports that are integrally attached to the supporting strip. The use of the supporting strip with the conductor within the channels creates a rectangular coaxial transmission line with the conductor forming the central conductor or network and the metallically coated channels forming the outer conductor. At the end of certain strips are vertically extending, cylindrically shaped posts which define the general structure of the probe.

A second arrangement of transmission lines is defined in the first power dividing layer in the same fashion as just described.

In still another preferred embodiment, the subarrays consist of 16 individual elements arranged in a 4×4 matrix and are constructed in a similar fashion to the embodiment just described. Each subarray consists of three layers stacked one on top of the other.

The middle layer is divided into two planar portions. The upper portion constitutes the first power dividing portion and the lower portion constitutes the second power dividing portion. The first power dividing portion is defined in the top planar surface of the middle layer. In like manner, the second power dividing portion is defined in the bottom planar surface of the middle layer. Channels of the type found in the previous embodiments are defined along both surfaces of the middle layer and are recessed into the layer. Positioned at predetermined locations throughout the channel are a series of conductor supports as in the first embodiment. Each of the supports contains an indentation for supporting a metallic conductor at the central location of each channel when the channel is viewed in cross-section to thereby set-up a conductive network. This arrangement creates a rectangular coaxial transmission line with the conductor forming the central conductor and the metallically coated channel forming the outer conductor. At the end of certain channels, the conductor terminates in a leg portion that is positioned to be aligned with one of the openings in the top layer. In an alternative embodiment, the leg, which lies in the same plane as the rest of the conductor, is bent upward so that the leg is normal to the conductor and the leg extends into the horn of an antenna element in the subarray to define an E-field probe.

It is thus a primary object of the present invention to provide an improved flat phased array antenna for both reception and transmission of high frequency signals.

It is another object of the present invention to provide an antenna incorporating a novel waveguide network.

It is a further object of the present invention to provide a phased array antenna that is easy and economical to manufacture and assemble.

It is yet another object of the present invention to provide an improved flat phased array antenna that is manufactured from economic materials such as molded plastic.

Further objects and advantages will become apparent from the following detailed description with reference to the accompanying drawings.

BRIEF DESCRIPTION OF THE DRAWINGS

FIG. 5 is a perspective view showing an antenna element which results when the structural components of FIG. 2 are assembled.

FIG. 6 is a portion in perspective not to scale to show the details associated with the waveguides defined in the subarray of FIG. 2.

FIG. 7 is a cross-sectional view similar to that of FIG. 4 to show a view of the way in which the probes are molded into the waveguide channels.

FIG. 8 is a view taken along lines 8—8 of FIG. 7.

FIG. 11 is a perspective view of a portion of the support strip with probes of FIG. 9.

FIG. 12 is a view in cross-section of an antenna element of the embodiment of FIG. 10.

FIG. 13 is a view in cross-section of an antenna element of the embodiment of FIG. 13.

FIG. 14 is an exploded perspective view of a detail of the embodiment of FIG. 10.

FIG. 15 is a schematic diagram in perspective of a detail for an alternative to the embodiment of FIG. 10.

DETAILED DESCRIPTION OF THE PREFERRED EMBODIMENTS

Figure 1:
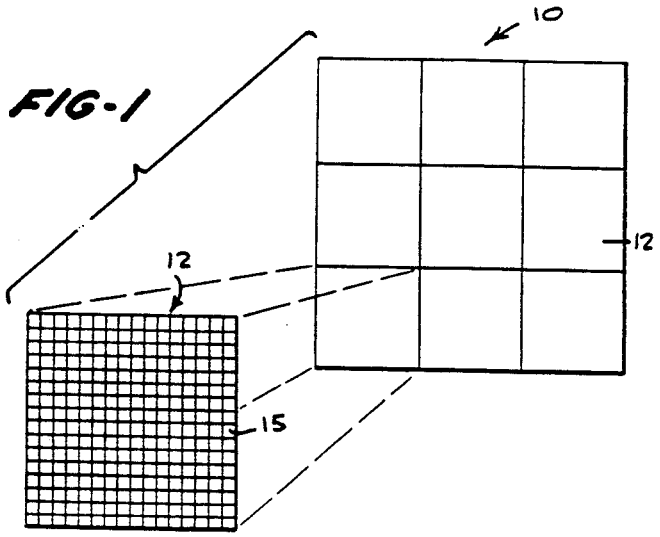
FIG. 1 is a schematic diagram showing a flat phased array incorporating the teachings of the present invention and constructed from a series of subarrays.

FIGS. 1 through 5 generally illustrate a preferred embodiment of a flat phased array antenna incorporating the teachings of the subject invention. The flat antenna array is generally designated as 10 and consists of a number of subarrays 12 arranged next to each other in a matrix. In FIG. 1, the flat antenna array consists of nine such subarrays 12 arranged in a 3×3 matrix. In turn, each of the subarrays consist of 256 individual elements 15. In subarray 12, the elements are arranged in a 16×16 matrix. Each of the elements has a spacing of 0.95 $\lambda_o$ where $\lambda_o$ is the free space wavelength at 12 GHz.

Figure 2:
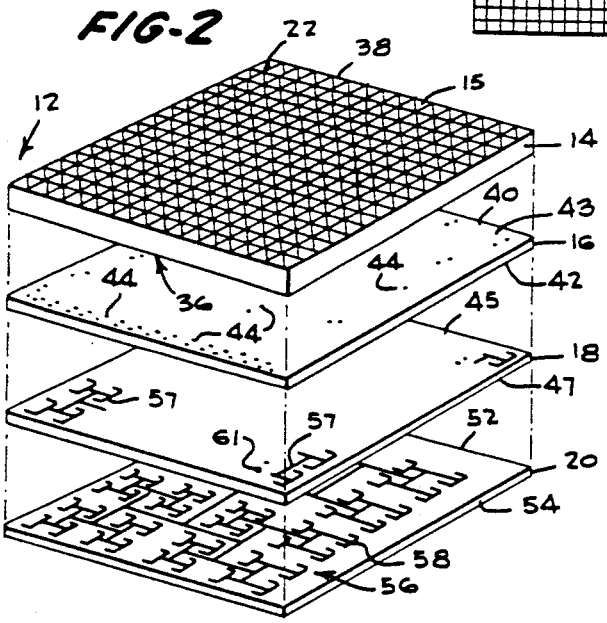
FIG. 2 is an exploded, schematic diagram in perspective not to scale to show the elements constituting a subarray of FIG. 1.

FIG. 2 is a schematic illustration not to scale of the general elements constituting a subarray 12. Basically, each subarray consists of four layers 14, 16, 18 and 20 stacked one on top of the other, with layer 14 being the uppermost layer and layer 20 being the lowermost layer. Each of the layers is fabricated from an insulated material such as plastic. Layer 14 defines a 16×16 array of miniature horns 22 of the type commonly used for capturing circularly polarized high frequency signals. The size of each horn is related to the wavelength of the incoming signal, when the array antenna is used for reception or the outgoing signal when the array antenna is used for transmission.

In a preferred embodiment, each of the horns has a lower section 24 of generally square cross-section and an upper face 26 of generally square cross-section. In an embodiment (FIG. 5), the square defining the upper face 26 is of greater dimension than the square defining the lower cross-section 24 of miniature horn 22. The upper portion of each horn 22 radiates inwardly and downwardly through the provision of planar walls 31 through 34 in conventional fashion to define a radiating section.

Figure 3:
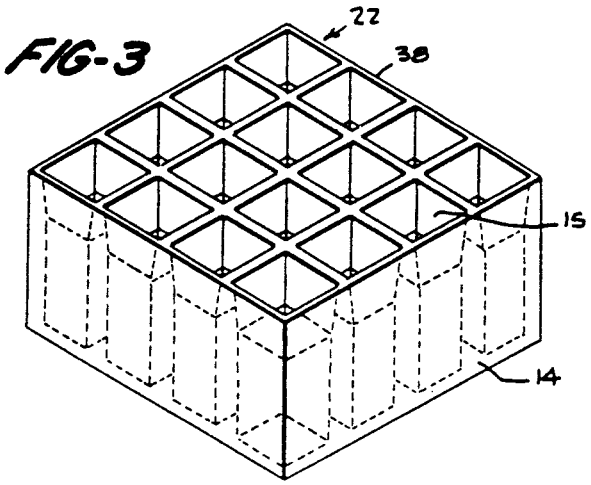
FIG. 3 is a perspective view showing a portion of the structure that makes up the miniature horns of the subarray of FIG. 2.

The bottom 36 of layer 14 terminates in a planar surface. Each of the antenna elements 22 extends completely from the top surface 38 of the layer 14 clear through to the bottom surface 36. Secured to layer 14 is layer 16 which constitutes the short-circuit plate of the antenna array. Layer 16 comprises a planar plastic member having a top planar surface 40 and a bottom planar surface 42. The top surface is coated by a thin layer of conductive metallic film 43 such as aluminum which has been deposited on the top surface of layer 16 by any well-known method such as vapor deposition. The metallic film is one which will reflect microwave energy. The metallic layer 43 of the short-circuit plate 16 is in intimate contact with the lower surface 36 and actually forms part of the horn array 14. In accordance with a predetermined design, the short-circuit plate contains a plurality of through holes 44 disposed about the surface 40 of the circuit plate in accordance with a predetermined design to permit passage of a pair of cylindrically shaped probes 46 therethrough. The layer 16 contains a sufficient number of through holes arranged to ensure that two probes 46 are contained inside each antenna element 22 throughout the entire antenna array. The specific way in which each of the antenna elements 22 receive a pair of probes 46 will be described in greater detail hereinafter. With reference to FIG. 3, the interior surface of each of the antenna elements is coated with a metallic film of the type that will reflect microwave energy. One such metallic film may be made from aluminum.

Figure 4:
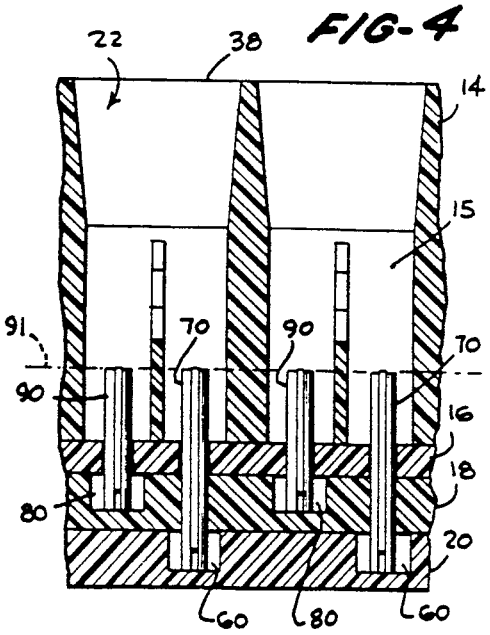
FIG. 4 is a view in cross-section showing two adjacent antenna elements.

Returning to FIG. 2, the two remaining layers 18 and 20 constitute the first power dividing layer and the second power dividing layer, respectively. The first power dividing layer is generally planar and contains a top planar surface 45 and a bottom planar surface 47. In like manner, the second power dividing layer 20 is generally planar and contains a top planar surface 52 and a bottom planar surface 54. The top surface 52 contains a transmission network 56 made up of a series of waveguide transmission lines 58 arranged in accordance with a well-known pattern. Each transmission line 58 consists of a hollow groove 60 or channel recessed into the layer 20. In a preferred embodiment, the grooves are generally rectangular in cross-section as shown in FIG. 4. However, depending on the intended use, the cross-section may take on other dimensional cross-sections such as a square. Positioned at predetermined locations throughout the channel are a series of conductor supports 62. These supports like layer 20 are made of plastic and may be secured into the channel 60 through any suitable means such as friction and welding or may be formed as part of the channel by molding. The complete interior surface of the channel is coated with a metallic film such as aluminum. Each of the supports 62 contains an indentation 64 for supporting a metallic conductor 66 at the central location of the channel 60 when the channel is viewed in cross-section. As can be seen, the bottom surface 47 of layer 18 defines a portion of the interior surface of the channel 60 of the transmission lines 58 created in layer 20. As needed, the bottom surface 47 of layer 18 contains a metallic film in order to define a portion of the interior closure of the transmission waveguide 60. This arrangement creates a rectangular coaxial transmission line with the conductor 66 forming the central conductor and the metallically coated channel forming the outer conductor. At the end of certain channels are vertically extending, cylindrically shaped posts 70 which define the general structure of a probe 46. Post 70 is made of a plastic material and is generally normal to the plane defined by the floor 61 of channel 60. The exterior cylindrical surface of post 70 is not coated in any way. The arrangement of the transmission lines 58 ensures that there is a post 70 positioned within each of the antenna elements 22 of the horn array layer 14.

Through the provision of either a longitudinally extending indentation 74 (FIG. 6) or a longitudinally extending central bore 76, the conductor 66 associated with the channel 60 containing the probe 46 extends from the secured lowered end 71 of the probe to the free end 73 of the probe and is then hooked to the top of the probe in a conventional manner as indicated by 81 in FIG. 11 to define an E-field probe.

An arrangement of transmission lines or network 57 similar to network 58 is defined in the first power dividing layer 18. In this arrangement, the transmission lines 57 each consists of a hollow groove or channel 80 recessed into the layer 18. In a preferred embodiment, the channels are generally rectangular in cross-section as shown in FIG. 4. However, depending on the intended use, the cross-section may take on alternative dimensions such as a square. Positioned at predetermined locations throughout the channel are a series of conductive supports 82. These supports are made of a plastic material and may be secured into the channel 80 through the same means used to secure supports 62 into channel 60. The complete interior surface of the channel 80 is coated with a metallic film such as aluminum. Each of the supports 82 contains and indentation 84 for supporting a metallic conductor 86 at the central location of the channel 80 when viewed in cross-section. As can be seen, the bottom surface 42 of layer 16 defines a portion of the interior surface of the channel 80 of the transmission lines 57 created in layer 18. As needed, the bottom surface 42 of the short-circuit plate 16 contains a metallic film in order to define a portion of the interior surface of the transmission waveguide 80.

At the end of certain channels are vertically extending cylindrically shaped posts 90 which define the general structure of probe 46. Post 90 is made of a plastic material and is similar to post 70 except that post 90 is of shorter height then post 70. This is done so that when the several layers are joined together as shown in FIGS. 2 and 4, the top or free ends of posts 90 and 70 will occupy the same plane 91 within an antenna element 22. The arrangement of the transmission lines 57 ensures that there is a post 90 positioned within each of the antenna elements 22 of the horn array layer 14. First power dividing layer 18 also includes a plurality of strategically placed through holes 61 to allow passage of posts 70 into antenna elements 22 of horn array layer 14.

In a preferred embodiment of the invention, the array gain should be equivalent to that of a 1.8 meters diameter reflector antenna. With an efficiency of 60%, this corresponds to 1.2 dBs at 12 GHz. To achieve the same gain with a uniformly excited array and assuming a total loss of 2 dB (made up of an element efficiency factor and feeder losses), the overall aperture dimensions should be approximately 45"×45". This may be made up of nine subarrays 12, each 15"×15" square, as shown in FIG. 1. The subarrays consist of 16×16 elements 22 with a spacing of 0.95 $\lambda_o$ is the free space wavelength) at 12 GHz.

With reference to FIGS. 5 through 10, the configuration of each antenna element as well as the orientation of the probes within the element are now described. When viewed in cross-section, as shown in FIG. 8, each antenna element has a generally square cross-section. Dividing the square into two rectangles is a planar vertically oriented septum 110. The septum is made of plastic and contains two planar surfaces 112 and 114 that are parallel to each other and coated with a thin metal film such as aluminum. As shown in FIG. 5, the septum contains a stepped portion 116 defined at its top. This step portion is designed to produce slant 45° linear polarization within the antenna element. Disposed on both sides of the septum are vertically oriented probes 46. Each of the probes is centrally located at the intersection of the diagonals of each of the rectangular sections 122 and 124 defined by the septum 110. As shown in FIG. 7, the center conductors 66 and 86 within the waveguides extends up through the probe 46 and are then hooked to the side of the probe in a fashion shown in FIGS. 9 and 10. As shown in FIG. 8, the portions of each of the central conductors 66 and 86 that emerges out of the top of the probe are oriented in line with each other to define a pair of E-field probes.

FIG. 2 generally shows a dual linearly polarized subarray design in a form suitable for NC machining, through the use of a conventional computer controlled automatic milling machine. In use, the horn radiators of the antenna elements 22 are fed from the rear using the "hook"-type probes 46 as shown in FIG. 7. To ensure adequate isolation between polarizations, the end-fed septum 110 acts as an orthomode transducer to provide orthogonal linear polarizations at 45° to the plane of the septum. Conventionally, this component is designed to introduce a 90° phase shirt between the two linear components in order to produce circular polarization. The septum 110 is designed for an optimized in-phase relationship in accordance with conventional practice. An advantage of the septum configuration is that the individual sections can be designed separately and the problem of matching the probe into rectangular waveguide sections 122 or 124 is well defined and understood. As highlighted in FIGS. 2 and 4, the power dividing networks are included on separate levels. A square coaxial transmission line 60 is assumed with the central conductor 66 supported on the plastic web 62 in a similar fashion to modern semi-rigid cables. This approach provides an easy method of aligning the positions of the square coaxial line conductors and the probe feeds. In addition, three-dimensional metallization techniques are available which avoid the need for soldered connections between the coaxial lines 66 and 86 and the probes 46. It is also noted from FIG. 4 that the use of square coaxial lines involve the machining of only one channel for each power dividing network.

Figure 9:
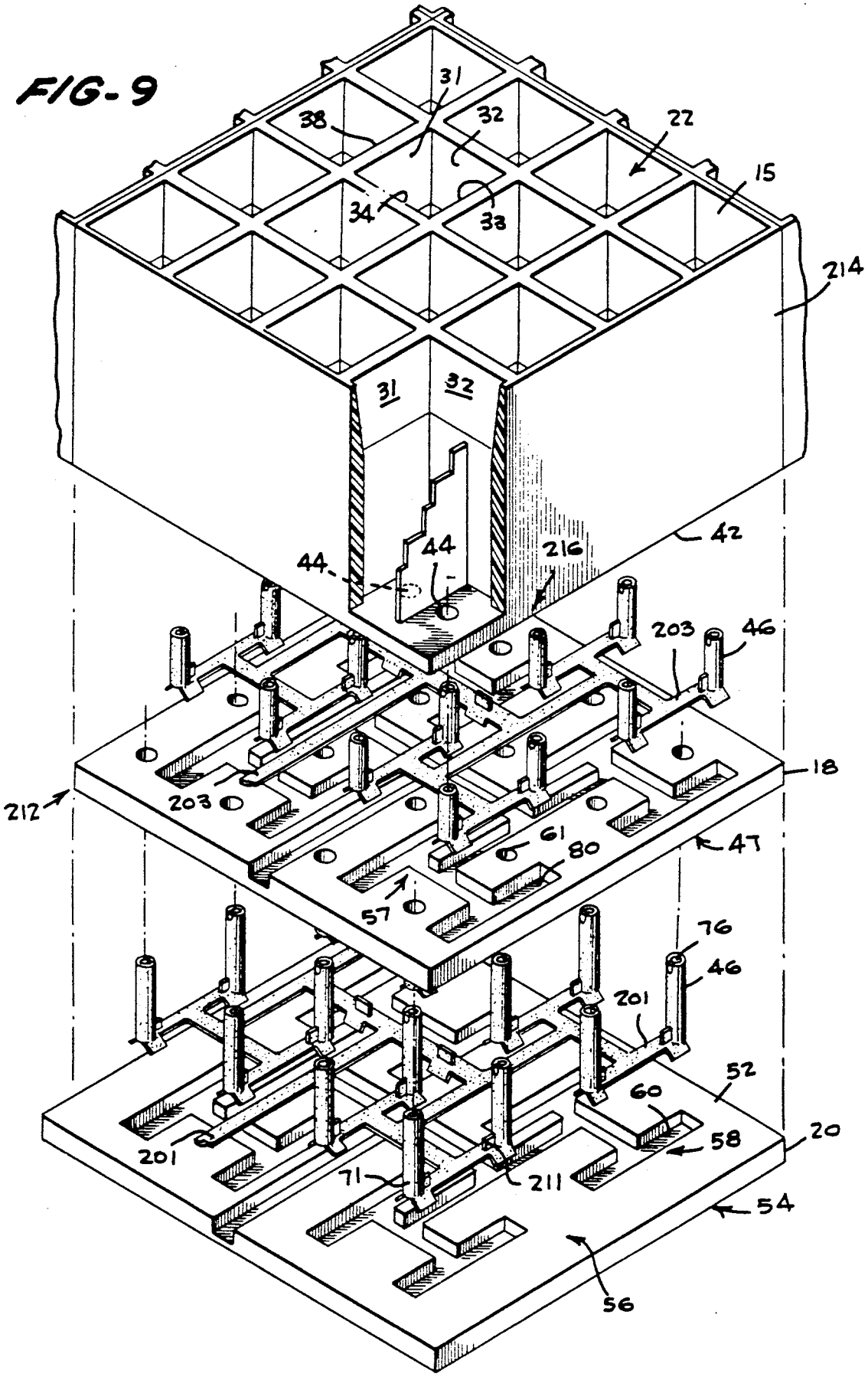
FIG. 9 is an exploded perspective view to show an alternative embodiment of a subarray.

FIGS. 9, 11, 13 and 14 illustrate another preferred embodiment of a portion of the flat phased array antenna incorporating the teachings of the subject invention. As in the FIG. 1 embodiment, the flat antenna array consists of a number of subarrays arranged next to .each other in a matrix. The array may be any size based on a multiple of the subarrays. In the embodiment of FIG. 9, each of the subarrays consist of 16 individual elements 15 arranged in a 4×4 matrix. Each of the elements has a spacing of 0.95 $\lambda_o$ where $\lambda_o$ is the free space wavelength at 12 GHz.

FIG. 9 is a schematic illustration of the general elements constituting a subarray 212. Basically, each subarray consists of three layers 214, 218 and 220 stacked one on top of the other, with layer 214 being the uppermost layer and layer 220 being the lowermost layer. Each of the layers is fabricated from an insulated material such as plastic. Layer 214, molded as a single piece, is essentially the same as the combination of layers 14 and 16 of FIG. 4. Thus, like numerals denote like elements.

The bottom 42 of layer 214 terminates in a planar surface. Each of the antenna elements 22 extends completely from the top surface 38 of the layer 214 clear through to the bottom surface 42. In accordance with a predetermined design, a short-circuit plate section 216 of layer 214 contains a plurality of through holes 44 to permit passage of a pair of cylindrically shaped probes 46 therethrough. A sufficient number of through holes ensure that two probes 46 are contained inside each antenna element 22 throughout the entire antenna array.

With reference to FIG. 9, the interior surface of each of the antenna elements 22 is coated with a metallic film of the type that will reflect microwave energy. One such metallic film may be made from aluminum.

Again, with reference FIGS. 9, 11, 13 and 14, the two remaining layers 218 and 220 constitute the first power dividing layer and the second power dividing layer, respectively, and of the same configuration and construction as the embodiment shown in FIG. 2. This, like numbers denote like elements. The first power dividing layer is generally planar and contains a top planar surface 45 and a bottom planar surface 47. In like manner, the second power dividing layer 20 is generally planar and contains a top planar surface 52 and a bottom planar surface 54. The top surface 52 contains a transmission network 56 made up of a series of waveguide transmission lines 58 arranged in accordance with a well-known pattern. Each transmission line 58 consists of a hollow groove 60 or channel recessed into the layer 20. In the preferred embodiment, the grooves are generally rectangular in cross-section as shown in FIG. 13. The complete interior surface of the channel is coated with a metallic film such as aluminum. Depending on the intended use, the cross-section may take on other dimensional cross-sections such as a square.

Positioned within channel 60 is a planar network of interconnected strips 201 made of a non-conductive material such as plastic. The strips are positioned within each channel 60 so that the plane of each strip is essentially parallel to the plane of layer 20 and so that the undersurface 205 is approximately halfway into channel 60. Metallic conductor 66 is secured to surface 205 along the longitudinal axis of each strip. Positioned at predetermined locations throughout the channel are a series of strip supports 211. These supports like layer 20 are made of plastic. Each of the supports 211, when viewed in cross-section as in FIG. 13, contains a pair of lower legs 213 and 215 for supporting strip 201 on floor 217 of channel 60 and an upwardly extending leg 221 that stabilizes strip 201 by pressing against bottom surface 47 of layer 18. The use of supporting strip 201 with conductor 66 within channel 60 creates a rectangular coaxial transmission line with the conductor 66 forming the central conductor and the metallically coated channel forming the outer conductor. At the end of certain strips 201 are vertically extending, cylindrically shaped posts 70 which define the general structure of a probe 46. These probes are generally normal to the plane of strip 201. Post 70 is made of a plastic material and molded as part of strip 201. The arrangement of the transmission lines 58 ensures that there is a post 70 positioned within each of .the antenna elements 22 of the horn array layer 14.

Through the provision of either a longitudinally extending central bore 76, the conductor 66 associated with the channel 60 containing the probe 46 extends from the secured lowered end 71 of the probe to the free end 73 of the probe and is then hooked to the top of the probe in a conventional manner as indicated by 81 in FIG. 11 to define an E-field probe.

An arrangement of transmission lines or network 57 similar to network 58 is defined in the first power dividing layer 18. In this arrangement, the transmission lines 57 each consists of a hollow groove or channel 80 recessed into the layer 18. In a preferred embodiment, the channels are generally rectangular in cross-section as shown in FIG. 13. The complete interior surface of the channel 80 is coated with a metallic film such as aluminum. However, depending on the intended use, the cross-section may take on alternative dimensions such as a square. Positioned within channel 80 is a planar network of interconnected strips 203 made of a non-conductive material such as plastic. The strips are positioned within each channel 80 so that the plane of each strip is essentially parallel to the plane of layer 18 and so that the undersurface 231 is approximately halfway into channel 80. Metallic conductor 86 is secured to surface 231 along the longitudinal axis of each strip. Positioned at predetermined locations throughout the channel are a series of strip supports 233. These supports are made of a plastic material. Each of the supports 233 contains the same leg arrangement as supports 211. In channel 80, leg 221 stabilizes strip 203 by pressing against bottom surface 42 of layer 14. As can be seen, the bottom surface 42 of layer 14 defines a portion of the interior surface of the transmission lines 57 created in layer 18. As needed, the bottom surface 42 contains a metallic film in order to define a portion of the interior surface of the transmission waveguide 80.

At the end of certain strips are vertically extending cylindrically shaped posts 90 which define the general structure of probe 46. These probes are generally normal to the plane of strip 203. Post 90 is molded as part of plastic strip 203 and is similar to post 70 except that post 90 is of shorter height then post 70. This is done so that when the several layers are joined together as shown in FIGS. 9 and 13, the top or free ends of posts 90 and 70 will occupy the same plane 91 within an antenna element 22. The arrangement of the transmission lines 57 ensures that there is a post 90 positioned within each of the antenna elements 22 of the horn array layer 14. First power dividing layer 18 also includes a plurality of strategically placed through holes 61 to allow passage of posts 70 into antenna elements 22 of horn array layer 14.

Figure 10:
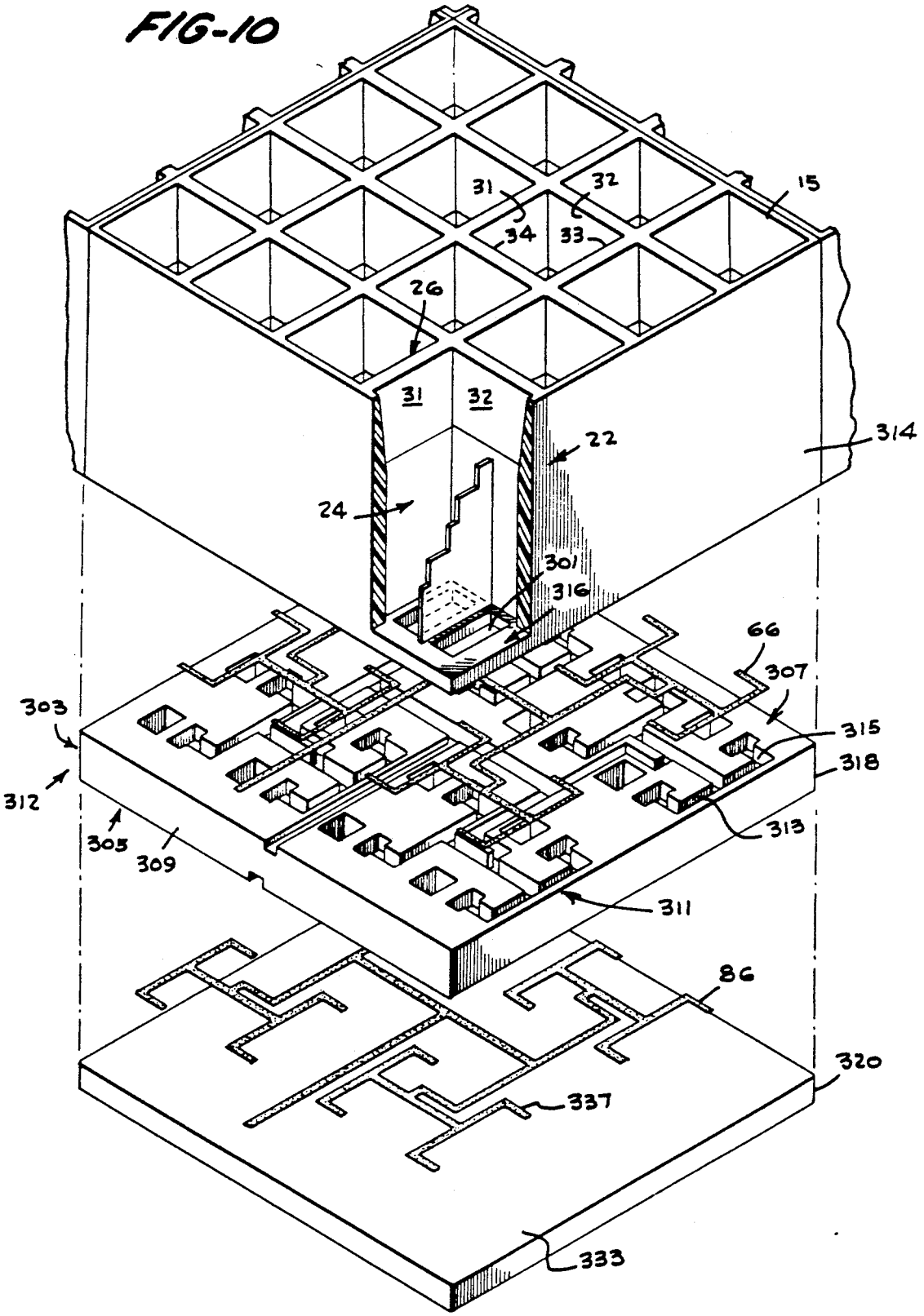
FIG. 10 is an exploded perspective view to show yet another alterative embodiment of a subarray.

FIGS. 10, 12 and 14 generally illustrate still another preferred embodiment of the flat phased array antenna incorporating the teachings of the subject invention. As with the two prior embodiments, the flat antenna array consists of a number of subarrays arranged next to each other in a matrix. The array may be any size based on a multiple of the subarrays. In the embodiment of FIG. 10, each of the subarrays consist of 16 individual elements 15 arranged in a 4×4 matrix. Each of the elements has a spacing of 0.95 $\lambda_o$ where $\lambda_o$ is the free space wavelength at 12 GHz.

FIG. 10 is a schematic illustration of the general elements constituting a subarray 312. Basically, each subarray consists of three layers 314, 318 and 320 stacked one on top of the other, with layer 314 being the uppermost layer and layer 320 being the lowermost layer. Each of the layers is fabricated from an insulated material such as plastic. Layer 314, molded as a single piece, is essentially the same as the combination of layers 14 and 16 of FIG. 4. Thus, like numerals denote like elements.

The bottom 42 of layer 314 terminates in a planar surface. Each of the antenna elements 22 extends completely from the top surface 38 of the layer 314 clear through to the bottom surface 42. In accordance with a predetermined design, a short-circuit plate section 316 contains a plurality of elongated slots 301 to either expose of portion of conductors 66 and 86 as to permit passage of the two conductors into the horn area of each antenna element. A sufficient number of slots 301 arranged to ensure that two conductors are contained inside each antenna element 22 throughout the entire antenna array.

With reference to FIG. 10, the interior surface of each of the antenna elements 22 is coated with a metallic film of the type that will reflect microwave energy. One such metallic film may be made from aluminum.

Again, with reference to FIGS. 10, 12 and 14, layer 318 is divided into two planar portions Upper portion 303 constitutes the first power dividing portion and lower portion 305 constitutes the second power dividing portion. The first power dividing portion is defined in top planar surface 307 of layer 318. In like manner, the second power dividing portion 305 is defined in bottom planar surface 309 of layer 318. The top surface 307 contains a transmission network 311 made up of a series of waveguide transmission lines 313 arranged in accordance with a well-known pattern. Each transmission line 313 consists of a hollow groove 315 or channel along a surface and recessed into the layer 318. In a preferred embodiment, the grooves are generally rectangular in cross-section as shown in FIG. 12. However, depending on the intended use, the cross-section may take on other dimensional cross-sections such as a square. Positioned at predetermined locations throughout the channel 315 are a series of conductor supports 317. These supports are made of plastic and may be secured into the channel 315 through any suitable means such as gluing or force fit into bores 319. The complete interior surface of the channel is coated with a metallic film such as aluminum. Each of the supports 319 contains an indentation 321 for supporting a metallic conductor 66 at the central location of the channel 315 when the channel is viewed in cross-section. This arrangement creates a rectangular coaxial transmission line with the conductor 66 forming the central conductor and the metallically coated channel 315 forming the outer conductor. At the end of certain channels, the conductor terminates in a leg portion 323 that is positioned to be aligned with one of the openings 301 in layer 314. In an alternative embodiment, the leg 323, which lies in the same plane as the rest of conductor 66, is bent upward so that the leg is normal to conductor 66 and the leg extends into the horn of an antenna element 22 to define an E-field probe.

An arrangement of transmission lines 325 similar to lines 313 is defined in the first power dividing portion 305. In this arrangement, the transmission lines 325 each consists of a hollow groove or channel 327 recessed into the bottom of layer 318. In a preferred embodiment, the channels are generally rectangular in cross-section as shown in FIG. 12. However, depending on the intended use, the cross-section may take on alternative dimensions such as a square. Positioned at predetermined locations throughout the channel are a series of conductive supports 329. These supports are made of a plastic material and may be secured into the channel 327 through the same means used to secure supports 321 into channel 315. The complete interior surface of the channel 327 is coated with a metallic film such as aluminum. Each of the supports 321 contains and indentation 331 for supporting a metallic conductor 86 at the central location of the channel 327 when viewed in cross-section. As can be seen, the top surface 333 of layer 320 defines a portion of the interior surface of the transmission lines 325 created in layer 318. As needed, the top surface 333 contains a metallic film in order to define a portion of the interior surface of the transmission waveguide 325.

At the end of certain channels the conductor 86 terminates in a leg portion 337 that is positioned to be aligned with one of the openings 301 in layer 314. In an alternative embodiment, the leg 337 extends into the horn of an antenna elements to define and E-field probe in the same way as leg 323 as shown in FIG. 15. First power dividing portion 303 includes a plurality of strategically placed slots 341 to allow exposure of leg 337 within the horn of antenna elements 22.

Many changes and modifications in the above embodiments of the invention can be made without departing from the scope of the invention. Accordingly, the scope is intended to be limited only by the appended claims.

What is claimed is:

1. In an antenna, a waveguide system comprising:

a first substantially planar layer having first and second surfaces;

first channels defined along said first surface and recessed within said first layer;

a first conductive network disposed in said first channels;

a second layer having a substantially planar third surface, said second layer being adjacent said first layer with said third surface of said second layer in intimate contact with said first surface, said third surface of said second layer providing a closure surface for closing said first channels;

support means originating within said first channels for supporting said first conductive network in spaced relation from the interior surfaces of said first channels;

an energy reflecting metallic coating surrounding the interior surfaces of said first channels, said metallically coated interior surfaces of said channels defining waveguide means for said first conductive network; and a conductive portion formed as part of said network, said conductive portion projecting outwardly from said first channels.

2. The waveguide system of claim 1, wherein said conductive portion defines an E-field probe.

* * * * *